United States Patent [19]

Joussemet

[11] 3,990,665

[45] Nov. 9, 1976

[54] DEVICE FOR HANGING SHELVES

[76] Inventor: Pierre Joussemet, 5 Bld Suchet, 75016 Paris, France

[22] Filed: May 29, 1975

[21] Appl. No.: 581,763

[30] Foreign Application Priority Data

May 29, 1974 France ..... 74.18694

[52] U.S. Cl. ..... 248/243; 108/149; 248/317

[51] Int. Cl.[2] ..... A47B 29/02; A47F 5/08

[58] Field of Search ..... 248/317, 342, 343, 235, 248/243; 108/149, 106, 107; 211/113; 5/9 R, 10 R

[56] References Cited

UNITED STATES PATENTS

| | | | |
|---|---|---|---|
| 1,325,320 | 12/1919 | Gosso | 5/9 R |
| 1,517,626 | 12/1924 | Herskovitz | 248/343 |
| 1,591,973 | 7/1926 | Grossheim | 248/317 X |
| 2,174,747 | 10/1939 | Hveglin | 248/343 |

FOREIGN PATENTS OR APPLICATIONS

| | | | |
|---|---|---|---|
| 493,288 | 5/1950 | Belgium | 108/149 |
| 222,248 | 10/1924 | United Kingdom | 108/149 |

*Primary Examiner*—J. Franklin Foss
*Attorney, Agent, or Firm*—Robert E. Burns; Emmanuel J. Lobato; Bruce L. Adams

[57] ABSTRACT

A shelf supporting apparatus comprising vertical cables extending between upper and lower anchoring members, attachment members being connected to the cables for receiving and supporting shelves and each cable being associated with a tensioning spring. Each lower anchoring member comprises two sockets housing a piston and the tensioning spring, the piston having an axial bore through which the cable extends. The upper anchoring member comprises a pair of screw engaging sockets housing a stop member to which the upper end of the cable is secured. Each attachment member is of unitary construction and has a slot for engaging the cable with screw holes at each end of the slot into which cable gripping screws can be engaged. The bulk of the anchoring members is reduced to a minimum.

5 Claims, 9 Drawing Figures

DEVICE FOR HANGING SHELVES

BACKGROUND OF THE INVENTION

This invention relates to apparatus for supporting shelves or the like and comprising vertical cables each stretched between an upper anchoring member fixed to the ceiling or other upper surface and a lower anchoring member fixed to the floor or other lower surface, a device for tensioning each cable being provided.

Such known apparatus are not completely satisfactory, since they comprise a large number of different parts, certain of which are small in dimension and may thus be easily lost, which consequently increases the cost price of the apparatus and the assembly time thereof. In addition, the anchoring members are generally bulky, which affects the aesthetic appearance of the apparatus.

SUMMARY OF THE INVENTION

It is the object of this invention to obviate or mitigate these drawbacks by new supporting apparatus. A lower anchoring member comprises a first socket having an internal screwthread and a base provided with a hole through which passes a fixing screw for screwing into the ground or lower surface, a piston provided at its lower end with a flange and with an axial hole through which the cable passes, the piston having at least one radial tapped hole into which is screwed a screw for locking the cable. A compression spring surrounds the piston and bears on the flange and on a circular inner face of a second socket which faces downwards. The second socket has an outer screwthread co-operating with the inner screwthread of the first socket, and has a circular end provided with a hole for passage of the piston emerging partly from this second socket.

The upper anchoring member comprises a first upper socket extending downwards from a ceiling or the like and having an outer screwthread and a circular face provided with a hole for the passage of a fixing screw screwed into the ceiling or upper surface. A second upper socket has an inner screwthread co-operating with the outer screwthread of the first upper socket, and a base provided with a hole for the passage of the cable.

Removable attachment members are preferably locked on the cable and each is in one piece and comprises a slot and at least one tapped hole at both ends of this slot and of the same depth and into which is screwed a locking screw immobilizing the attachment member on the cable.

BRIEF DESCRIPTION OF THE DRAWINGS

Embodiments of the present invention will now be described, by way of example, with reference to the accompanying drawing, in which.

DESCRIPTION OF PREFERRED EMBODIMENTS

Figures 1, 2, 3, 4, 5, 6, 7, 8, 9:
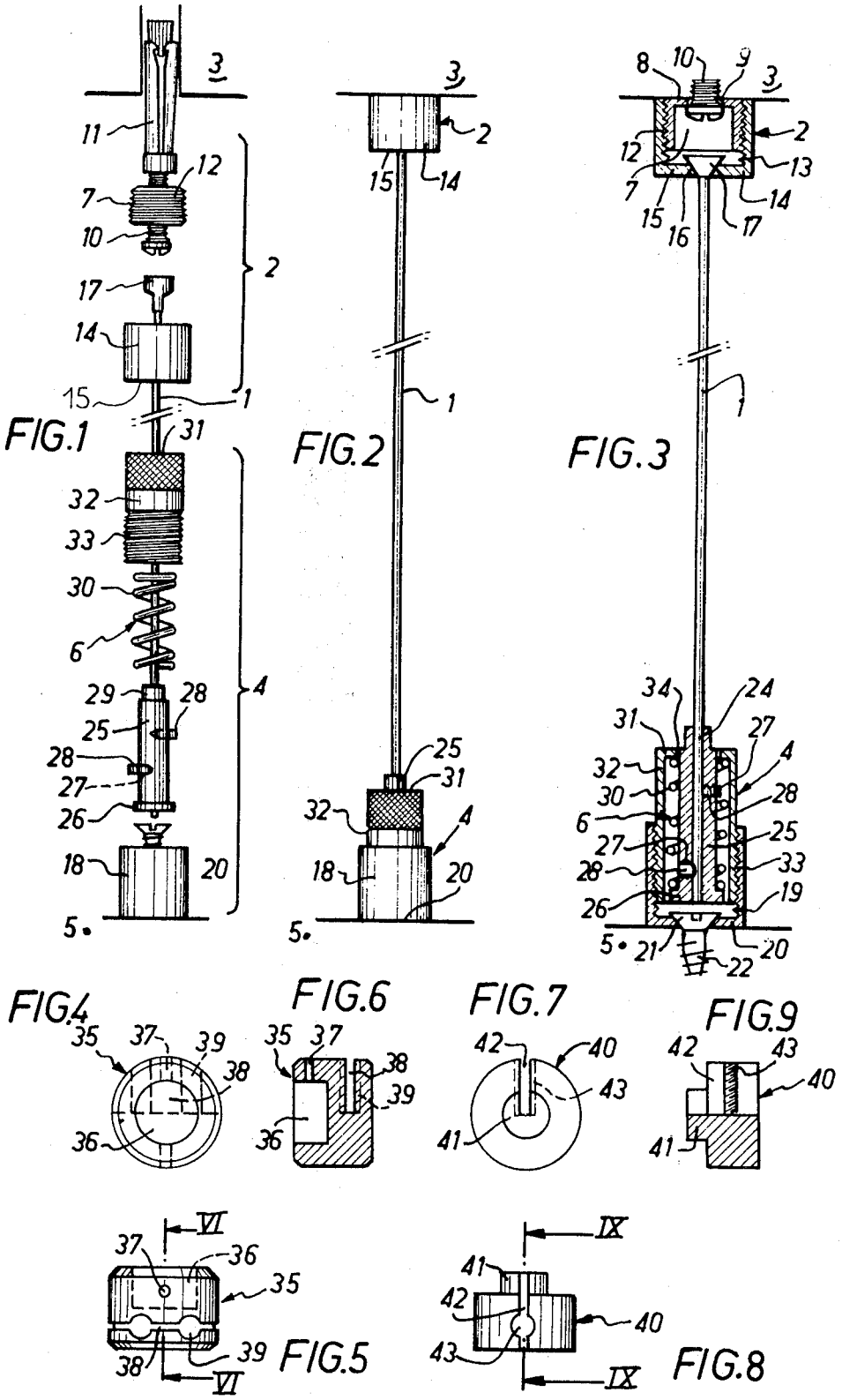
FIG. 1 is an elevation of the supporting apparatus according to the invention before assembly.
FIG. 2 is a corresponding elevation in the assembled position.
FIG. 3 is a vertical axial sectional view of the apparatus.
FIG. 4 is an elevation of a first embodiment of an member.
FIG. 5 is a corresponding plan view.
FIG. 6 is a sectional view on line VI—VI of FIG. 5.
FIG. 7 is an elevation of a second embodiment of an attachment member.
FIG. 8 is a corresponding plan view.
FIG. 9 is a sectional view on line IX—IX of FIG. 8.

The supporting apparatus comprises a cable 1 stretched between an upper anchoring member 2 fixed to a ceiling 3 and a lower anchoring member 4 fixed to the floor 5 and provided with a tensioning device 6 for the cable 1.

The upper anchoring member 2 comprises a first upper socket 7 extending downwards from ceiling 3. An upper circular end 8 of socket 7 is provided with a hole 9 through which passes a fixing screw 10 whose head bears against the circular end 8 and whose body is screwed into a peg 11 engaged in the ceiling 3. The first socket 7 has an outer screwthread 12 complementing an inner screwthread 13 of a second upper socket 14, extending upwards from a base 15 which has a chamfered hole 16 through which passes the cable 1 at the upper end of which is fixed an inverted cone 17 or a ring or the like bearing against the base 15 in the chamfered hole 16. The height of the second socket 14 is greater than that of the first socket 7 so that the latter is entirely housed inside this second socket.

The lower anchoring member 4 and the tensioning device 6 comprise a first lower socket 18, extending upwards from floor 5, having an inner screwthread 19 and a circular base 20 provided with a chamfered hole 21 through which passes a fixing screw 22, whose head bears against the base 20, the body of the screw being screwed into the ground 5. At its lower end, the cable 1 is engaged in an axial hole 24 provided in an elongated piston 25 comprising a flange 26 at its lower end. The piston 25 is also provided with two radial tapped holes 27 into which are screwed locking screws 28. At its upper part, the piston 25 comprises two flat parts 29. The lower anchoring member 4 also comprises a compression spring 30 (which is the tensioning device 6) surrounding the body of the piston 25, bearing firstly against the flange 26 of this piston and secondly against the circular end 31 of a second lower socket 32. The latter socket extends downwards from end 31 to an outer screwthread 33 co-operating with the inner screwthread 19 of the first socket 18. The outer diameter of the flange 26 is slightly smaller than the inner diameter of the second socket 32 in order to ensure guidance of the piston in this socket. In the normal state, the length of the compression spring 30 is substantially equal to the height of the second socket 32. The length of the piston 25 is greater than the height of the second socket 32 and the result is that the upper part of the piston projects from the upper side 31 through a hole 34 provided in this side.

Assembly of the apparatus according to the invention is carried out in the following manner. The second upper socket 14 and then the second lower socket 32 and finally the compression spring 30 are engaged around the cable 1.

The cable 1 is engaged in the axial hole 24 of the piston 25 and the cable is locked at the desired location by means of the screws 28.

When the peg 11 is in position in the ceiling 3, the first socket 7 is secured by means of the screw 10.

When the first socket 7 is in position, the second socket 14, whose outer screwthread 12 and inner screwthread 13 are complementary, is screwed to this first socket.

The first lower socket 18 is anchored to the ground by means of the fixing screw 22. After possible adjustment of the piston 25 along the cable 1, socket 32 is screwed to socket 18, whose outer screwthread 33 and inner screwthread 19 respectively are complementary.

The apparatus is thus in the form shown in FIG. 2. The bulk of the upper anchoring members 2 and lower anchoring members 4 is reduced to a minimum, corresponding respectively to the height of the first socket 7 and substantially to the length of the piston 25. Naturally, the position of the piston 25 along the cable 1 is such that after assembly of sockets 18, 32 and 7, 14 the compression spring 30 is slightly compressed to tension this cable.

The apparatus also comprises removable attachment members locked on the cables and making it possible to secure and support shelves or the like on the cables. An attachment member according to the invention is in a single piece and comprises a slot and a tapped hole at both ends of this slot and of the same depth, into which is screwed a screw for locking the cable.

FIGS. 4 to 6 show a first embodiment of attachment member 35 of general cylindrical shape comprising a blind cylindrical hole 36 on one of its circular sides. A tapped hole 37 opening firstly into the blind hole 36 and secondly into the cylindrical side of the member 35 facilitates screwing of a screw for locking a shelf or the like to the member 35. The member 35 also comprises a slot 38 of semicircular shape and of width substantially equal to the diameter of the cable 1 and two tapped holes 39 constituting enlargements of this slot 38 which make it possible to lock a cable 1, housed in the slot, by means of two screws screwed into the tapped holes 39 and engaging the cable 1.

FIGS. 7 to 9 show a second embodiment of attachment member of general cylindrical shape, extended, from one of its circular sides, by a cylindrical projection 41. The attachment member is also provided with a slot 42 located in an axial plane and the width of which is substantially equal to the diameter of the cable. A tapped hole 43 overlaps this slot 42 and makes it possible to lock the cable in the bottom of the slot by means of a locking screw.

Naturally, the invention may be the subject of modifications as concerns the anchoring members and attachment members. Thus, according to one possible modification, a one-piece attachment member is constituted by two members such as those illustrated in FIGS. 4 to 6, joined back-to-back.

What is claimed is:

1. Apparatus for supporting shelves and the like, comprising; upper anchoring means for securement to an upper surface, lower anchoring means for securement to a lower surface, a vertical cable extending between said upper and lower anchoring means, and an attachment member removably attachable to the cable, the lower anchoring means comprising a first lower socket normally extending upwards from the lower surface and having an inner screwthread and a base portion with a hole therein, a fixing screw extending through the hole for screwing the first lower socket to the lower surface, a piston having a lower end, with a flange extending outwardly therefrom, the piston having an axial hole through which the cable extends and having a radial tapped hole and a screw engageable therein for securing the piston to the cable, a second lower socket having an outer screwthread cooperating with said inner screwthread and having an end with a central hole therein through which an end portion of the piston emerges upwardly, and a compression spring disposed in the first lower socket, surrounding the piston and bearing on the flange and on an inner circular surface of the second lower socket for tensioning the cable, the upper anchoring means comprising a first upper socket normally extending downwards from the upper surface, having an outer screwthread and an upper end with a central hole therein, an upper fixing screw passing through the latter hole, a peg engageable by the upper fixing screw for holding the first upper socket to the upper surface, a second upper socket having an inner screwthread complementing the outer screwthread of the first upper socket and having a base with a central hole therein through which the cable extends, and a stop member secured to an upper end of the cable and engageable with the base around the hole therein, and the attachment member comprising a single body having a slot for removeably engaging said member with the cable, and means for immobilizing the attachment member with the cable engaged in the slot.

2. Apparatus according to claim 1, in which the compression spring has a length, in the normal state thereof, substantially equal to the height of the second lower socket.

3. Apparatus according to claim 1, in which the second upper socket has a height greater than the height of the first upper socket.

4. Apparatus according to claim 1 in which the hole in the base of the second upper socket is chamfered and the stop member is an inverted cone engaging the chamfered hole.

5. Apparatus according to claim 1 in which the means for immobilizing the attachment member comprises means defining a tapped hole which constitutes an enlargement of the slot, for threading a locking screw into the tapped hole to effect the immobilizing of said member with the cable.

* * * * *